US006532923B2

(12) United States Patent
Woodward et al.

(10) Patent No.: US 6,532,923 B2
(45) Date of Patent: Mar. 18, 2003

(54) ADJUSTABLE CAM SPROCKET

(75) Inventors: Thomas D. Woodward, Portage, IN (US); Michael G. Zerbe, Elmhurst, IL (US)

(73) Assignee: Dynagear, Inc., Downers Grove, IL (US)

( * ) Notice: Subject to any disclaimer, the term of this patent is extended or adjusted under 35 U.S.C. 154(b) by 0 days.

(21) Appl. No.: 10/186,169

(22) Filed: Jun. 28, 2002

(65) Prior Publication Data

US 2003/0010304 A1 Jan. 16, 2003

Related U.S. Application Data

(63) Continuation of application No. 09/476,731, filed on Dec. 30, 1999, now abandoned.

(51) Int. Cl.[7] ..... F01L 1/34

(52) U.S. Cl. ..... 123/90.17; 123/90.15; 74/568 R

(58) Field of Search ..... 123/90.15, 90.17, 123/90.31; 74/568 R, 395, 464; 474/900, 902; 81/176.1, 176.15, 461

(56) References Cited

U.S. PATENT DOCUMENTS

| | | | | |
|---|---|---|---|---|
| 379,022 A | | 3/1888 | Morgan | |
| 1,040,063 A | | 10/1912 | Wall | |
| 1,691,408 A | | 11/1928 | Palmer | |
| 3,237,469 A | | 3/1966 | Berry et al. | |
| 3,369,418 A | | 2/1968 | Young | |
| 3,490,303 A | | 1/1970 | Rosenberg | |
| 3,523,465 A | | 8/1970 | Harrell | |
| 3,734,073 A | | 5/1973 | Walter et al. | |
| 3,789,687 A | * | 2/1974 | Cutter | 474/152 |
| 4,096,836 A | | 6/1978 | Kopich | |
| 5,002,023 A | | 3/1991 | Butterfield et al. | |
| 5,046,460 A | | 9/1991 | Butterfield et al. | |
| 5,174,169 A | | 12/1992 | Allen | |
| 5,181,432 A | | 1/1993 | Allen | |
| 5,203,291 A | | 4/1993 | Siga et al. | |
| 5,297,507 A | | 3/1994 | Ma | |
| 5,327,859 A | | 7/1994 | Pierik et al. | |
| 5,495,776 A | | 3/1996 | Allen | |
| 5,609,127 A | | 3/1997 | Noplis | |
| 5,680,836 A | | 10/1997 | Pierik | |
| 5,738,055 A | | 4/1998 | Allen | |

* cited by examiner

*Primary Examiner*—Thomas Denion
*Assistant Examiner*—Jaime Corrigan
(74) *Attorney, Agent, or Firm*—RatnerPrestia

(57) ABSTRACT

An adjustable camshaft sprocket assembly for attachment to a camshaft. A camshaft sprocket is removably securable to a camshaft sprocket hub and moveable, independent of the camshaft sprocket hub when the camshaft sprocket assembly is mounted on the camshaft. An adjustment tool is used to adjust the camshaft sprocket comprising at least two extensions. The first extension is of a size to fit within one a corresponding opening in the camshaft hub. The second extension is of a size to pass though a different corresponding opening in the camshaft hub and fit within a corresponding opening in the camshaft sprocket. A handle extension is used for turning the adjustment tool about the second extension, which serves as a pivot.

37 Claims, 7 Drawing Sheets

ADJUSTABLE CAM SPROCKET

This application is a continuation of U.S. patent application Ser. No. 09/476,731, filed Dec. 30, 1999 now abandoned.

FIELD OF INVENTION

The present invention relates to internal combustion engine valve timing. More particularly, the present invention relates to adjustable cam sprockets for adjusting engine valve timing of an automotive internal combustion engine.

BACKGROUND OF THE INVENTION

Most vehicle engines are internal combustion engines that use intake valves to control the entry of combustible gases (i.e. air/gas mixture) into a combustion chamber for ignition by a spark. Following combustion, exhaust valves control the escape of exhaust gases resulting from the combustion. Both the intake valves and the exhaust valves are controlled by cams lobes located on a camshaft. Pistons located in the combustion chamber are driven by the combustion of the combustible gases to cause the rotation of a crankshaft. The crankshaft is used to change the up-and-down motion of the piston into a turning or rotating force. This force is then used to drive the wheels of the vehicle.

The timing of the opening and closing of the intake and exhaust valves relative to the position of the pistons is very important for the operation and performance characteristics of the engine. Optimum performance is achieved when the intake and exhaust valves are operated at a precise position relative to the position of the pistons. A sprocket and chain system is generally used to control the timing of the camshaft rotation (intake and exhaust valve opening) to the crankshaft rotation (piston position). A combination of camshaft sprocket, timing chain and crankshaft sprocket is commonly referred to as a timing set and controls this timing. Adjustment of the rotation of the camshaft relative to the crankshaft of even 1° or 2° can effect engine performance. For this reason, the timing for an engine is usually a design characteristic of the engine that is determined and fixed by the engine manufacturer. The timing is usually fixed by a positioning "key" and keyways on both the crank shaft/crank sprocket and the camshaft/cam sprocket or the camshaft/cam sprocket by means of a dowel pin and mating dowel holes.

Determining optimum performance, however, depends upon the particular task for which the engine is being used. The preset engine timing from the manufacturer may be sufficient for a wide range of engine use, but may not be optimum for a particular purpose, such as high performance (long or short racing), off-roading or towing. Advancing the camshaft (by adjusting the camshaft position relative to the crankshaft) increases the lower RPM power. Retarding the camshaft improves the higher RPM power.

Replacement timing sets have been available to replace the original equipment timing set of a vehicle to allow adjustment of the engine timing from the preset manufacturers timing specification. Some of these "after market" timing sets have a crankshaft sprocket with multiple keyways in its bore. A problem with such a system is that the use is limited to the number of keyways and the fixed timing specification of each keyway. In addition, such timing adjustment systems require that the timing set (either partially or completely) be removed to make the adjustment, adding time and labor to the task. Other adjustment systems provide for adjustment of the camsprocket relative to the camshaft. In many such systems, however, it is also necessary to remove the timing set (either partially or completely) to make the adjustment.

SUMMARY OF THE INVENTION

The present invention provides for an adjustable camshaft sprocket assembly for attachment to a camshaft. A camshaft sprocket is removably securable to a camshaft sprocket hub and moveable, independent of the camshaft sprocket hub when the camshaft sprocket assembly is mounted on the camshaft.

An adjustment tool is used to adjust the camshaft sprocket. The camshaft tool is comprised of at least two extensions; the first extension is of a size to fit within one a corresponding opening in the camshaft sprocket hub. The second extension is of a size to pass though a different corresponding opening in the camshaft hub and fit within a corresponding opening in the camshaft sprocket. A handle extension is used for turning the adjustment tool about the first extension, which serves as a pivot.

BRIEF DESCRIPTION OF THE DRAWINGS

The present invention, as well as other features and advantages thereof, will now be described by way of non-limiting example with reference to the following figures in which.

DETAILED DESCRIPTION

Figure 1:
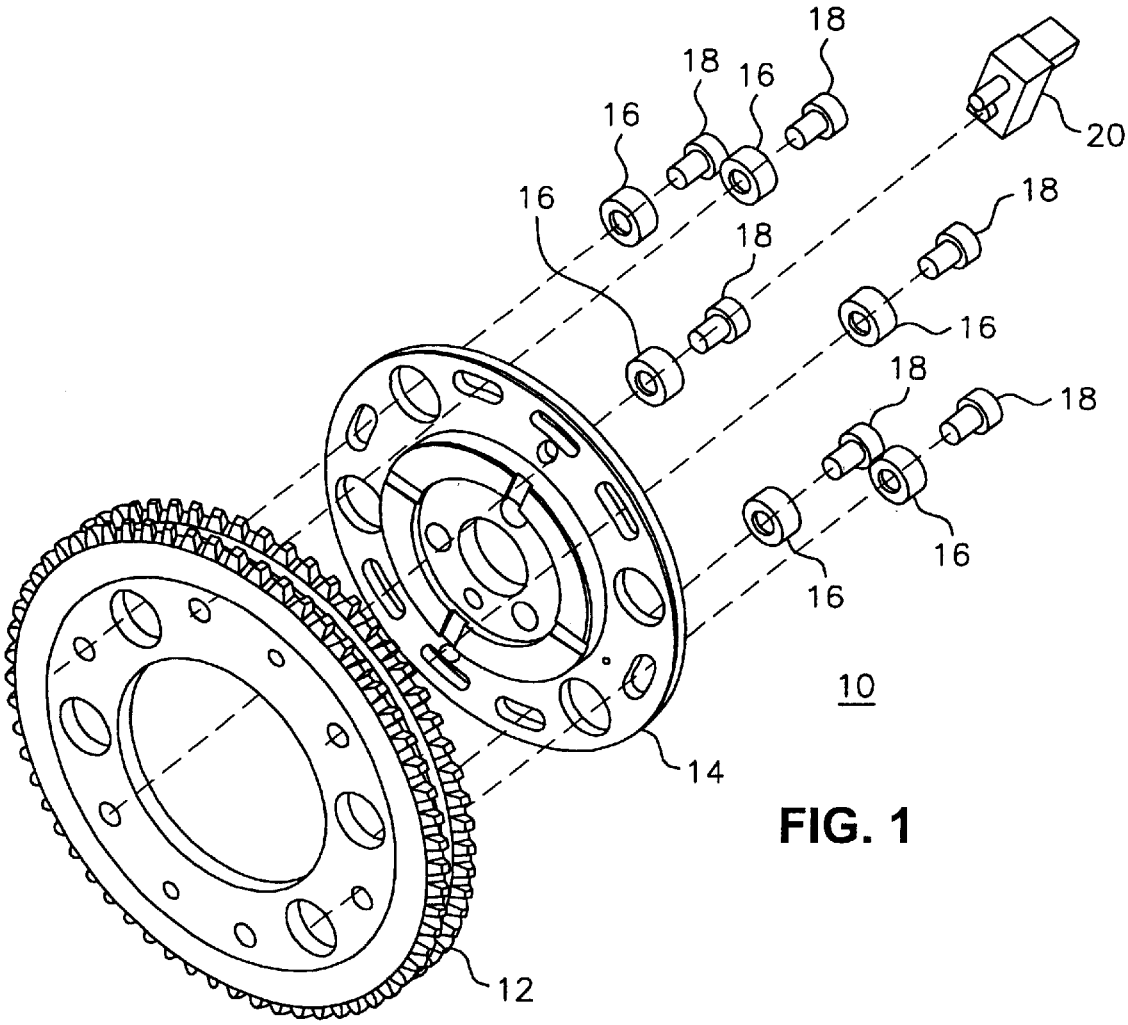
FIG. 1 is an exploded view of an exemplary embodiment of the present invention.
Figure 2:
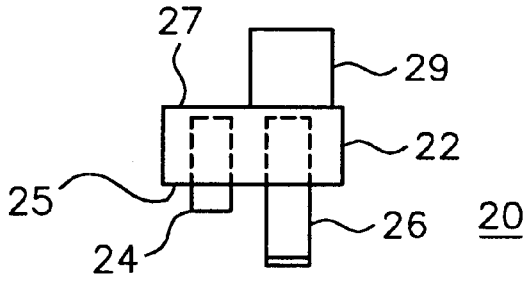
FIG. 2 is a side view of a camshaft sprocket timing adjustment tool in accordance with the present invention.
Figure 3:
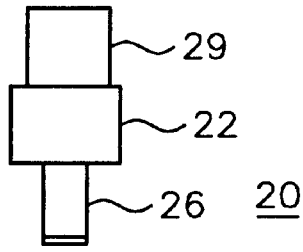
FIG. 3 is front view of the camshaft sprocket timing adjustment tool shown in FIG. 2.
Figure 4:
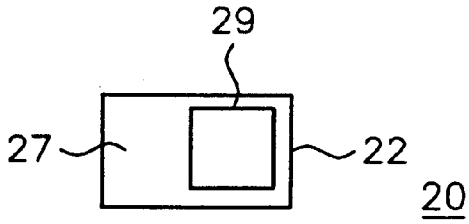
FIG. 4 is a top view of the camshaft sprocket timing adjustment tool shown in FIG. 2.
Figure 5:
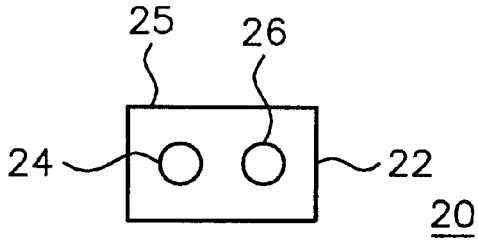
FIG. 5 is a bottom view of the camshaft sprocket timing adjustment tool shown in FIG. 2.

There is shown in FIG. 1 an exploded view of an exemplary embodiment of an adjustable camshaft sprocket assembly 10 in accordance with the present invention. A camshaft sprocket hub 14 nests with camshaft sprocket 12. Securing bolts 18 secure camshaft sprocket hub 14 to camshaft sprocket 12. Securing bolts (fasteners) 18 are inserted into washers 16 before securing camshaft sprocket hub 14 to camshaft sprocket 12. Timing adjustment tool 20, while not a part of camshaft sprocket assembly 10, is used to make timing adjustments to camshaft sprocket assembly 10.

Timing adjustment tool 20 is further illustrated in FIGS. 2–5. A short protrusion or dowel 24 extends from bottom surface 25 of body portion 22 of timing adjustment tool 20. A long protrusion or dowel 26 also extends from bottom surface 25 of body 22. Long dowel 26 extends further from bottom surface 25 than does short dowel 24. Short dowel 24 and long dowel 26 are shown in longitudinal alignment along bottom surface 25 of body 22. In an exemplary embodiment, both short dowel 24 and long dowel 26 are made from a hardened steel and extend into body 22, as shown in phantom in FIG. 1. Other suitable metals and attachment means will be understood by those skilled in the art. A handle extension 29 extends from top surface 27 of body 22. An exemplary embodiment of handle extension 29 is shown in a substantially square configuration for use with a socket wrench, box end wrench, or similar tool. In this embodiment, handle extension 29 is 0.375" square. This allows timing adjustment tool 20 to be used as a socket (socket head) when adjusting camshaft sprocket assembly 10. A socket or similar tool allows leverage and torque to be applied when adjusting the advance or retard of camshaft sprocket assembly 10. A hex or other configuration may be used as well, depending upon the tool used. Instead of extension 29, a slot may be formed in body 22, for rotation with a levered screwdriver. In an alternative embodiment, not shown, timing adjustment tool 20 is attached to lever arm, in a similar orientation to that when attached to a socket wrench for the configuration shown. In such an embodiment, a separate socket wrench would not be necessary. In such an embodiment, the lever arm need not be ratcheting in its attachment to timing adjustment tool 20. In an additional embodiment body 22, short dowel 24, long dowel 26 and handle extension 29 are made from a single piece of hardened steel.

Figure 7:
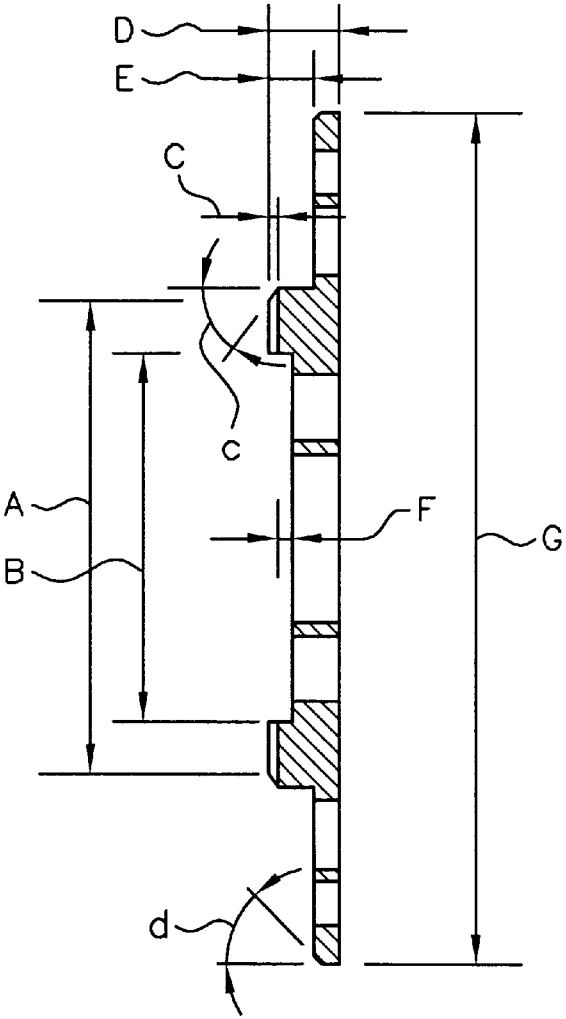
FIG. 7 is a side view of the camshaft sprocket hub shown in FIG. 1.
Figure 6:
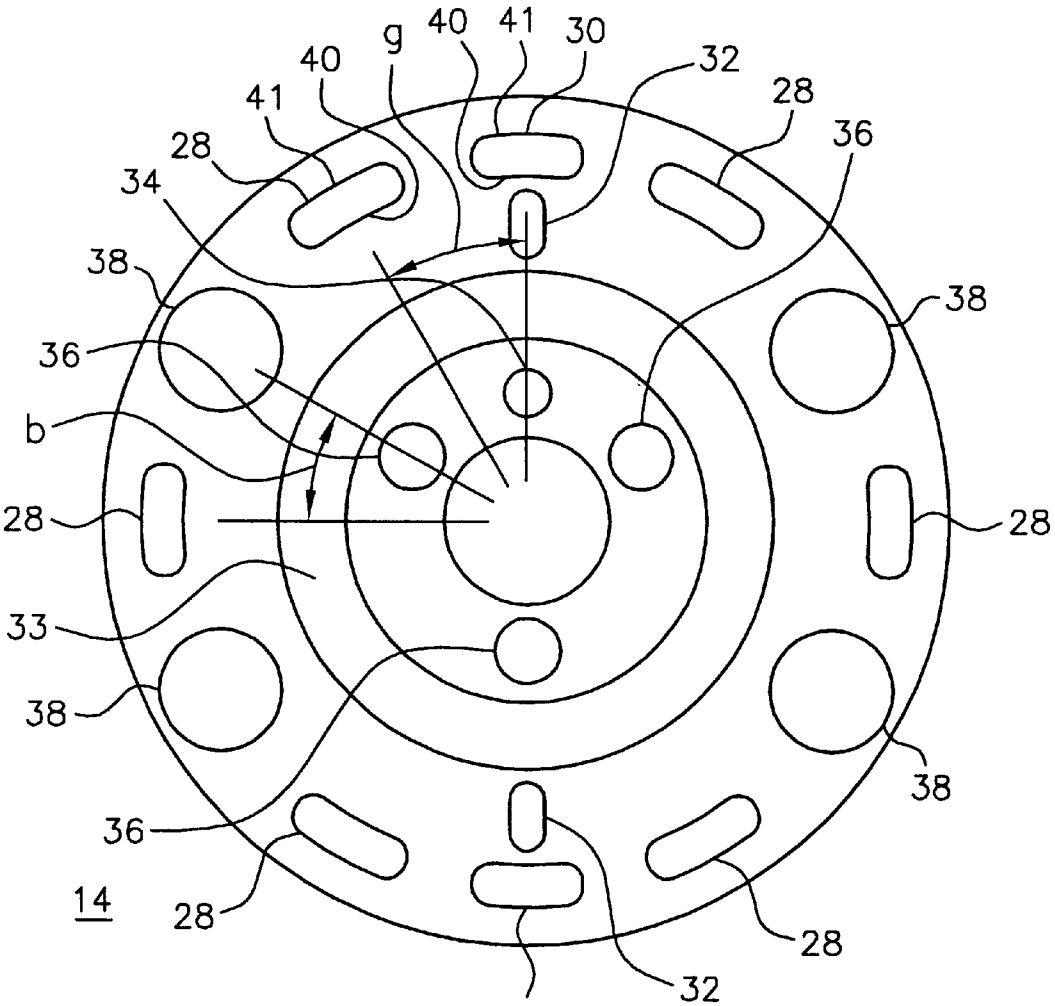
FIG. 6 is a top view of the camshaft sprocket hub shown in FIG. 1.

A top view of camshaft sprocket hub 14 is shown in FIG. 6 with a corresponding side view shown in FIG. 7. Camshaft sprocket hub 14 is separate from and nests with camshaft sprocket 12. A plurality of elongated, oval shaped openings 28 are evenly positioned toward the outer perimeter of camshaft sprocket hub 14. In an exemplary embodiment, each securing bolt opening 28 is spaced approximately 60° on center from each of its adjacent securing bolt opening 28. Each opening 28 is of a sufficient diameter to receive and allow the shaft portion of a securing bolt 18 to pass through camshaft sprocket hub 14. A pair of long dowel openings 30 are positioned 180° apart from each other and approximately 30° apart from the adjacent securing bolt receiving openings 28. Each long dowel opening 30 is of a sufficient diameter to receive and allow long dowel 26 of camshaft timing adjustment tool 20 to pass through camshaft sprocket hub 14. Positioned interior to each long dowel opening 30 is a short dowel recess 32. At least one long dowel opening 30 and short dowel recess 32 pair is needed for the present invention. More than one pair of long dowel opening 30 and short dowel recess 32 allows timing adjustments to be made from alternate locations using timing adjustment tool 20. Multiple adjustment locations for a user to select from, makes timing adjustments easier and more convenient for the user. Short dowel recess 32 is of a sufficient size to receive short dowel 24 of camshaft adjustment tool 20. Short dowel recess 32 is of a sufficient depth and diameter to securely receive short dowel 24 when inserted, but has a bottom surface (not shown), so as not to allow short dowel 24 to pass through camshaft sprocket hub 14.

Each long dowel opening 30 and camshaft securing bolt opening 36 has a lower edge 40 and an upper edge 41. Lower edge 40 and upper edge 41 are curved to approximate the curve of the camshaft hub 14. Each edge is an arcuate curved surface.

A rim 33 is positioned interior to short dowel recesses 32. Rim 33 provides alignment when nesting camshaft sprocket hub 14 with camshaft sprocket 12. Interior to rim 33 is dowel hole 34. Dowel hole 34 is of a sufficient depth and diameter to receive a dowel (not shown) attached to a camshaft (not shown). Three camshaft sprocket securing bolt openings 36 are positioned approximately equidistant from each other. Dowel hole 34 is positioned approximately 60° from each of the adjacent camshaft sprocket securing bolt openings 36. The number, position and orientation of dowel hole 34 and camshaft sprocket securing bolt openings 36 is determined by the corresponding structure of the camshaft to which camshaft sprocket assembly 10 is being attached.

Four optional weight reduction openings 38 are used in an exemplary embodiment.

In an exemplary embodiment, camshaft sprocket assembly 10 is used for a Chevrolet® small block engine. For such an embodiment, camshaft sprocket 12 and camshaft sprocket hub 14 are each machined from a blank of SAE 1144 billet steel; camshaft sprocket securing bolt openings 36 have an approximately 0.344" diameter; dowel hole 34 has an approximately 0.2505" diameter; weight reduction openings 38 have an approximately 0.625" diameter; long dowel openings 30 and camshaft sprocket assembly securing bolt openings 28 have a length that allows a total of 12° (6° advance from center and 6° retard from center) range of motion; short dowel 24 extends 0.125" from bottom surface 25 with a diameter of 0.1875"; long dowel 26 extends 0.375" from bottom surface 25 with a diameter of 0.1875"; and the following are approximate measurements for some of the dimensions shown in FIGS. 6 and 7.

| | |
|---|---|
| A = 2.623–2.625" | $\alpha = 30°$ |
| B = 1.868" | $\beta = 30°$ |
| C = .035" | $\chi = 45°$ |
| D = .355" | $\delta = 45°$ |
| E = .230" | |
| F = .119" | |
| G = 4.373–4.375" | |

Figure 9:
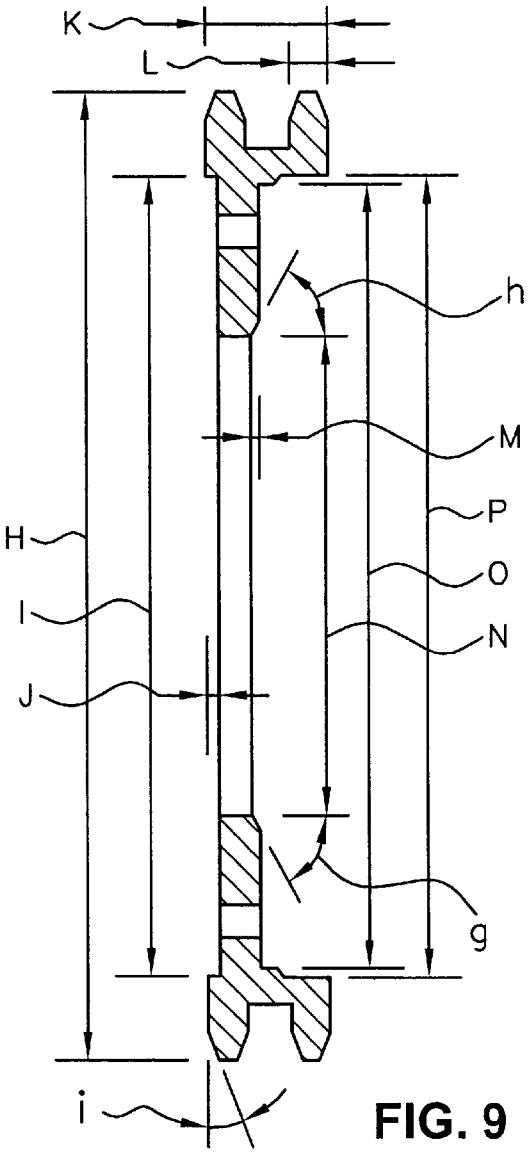
FIG. 9 is a side view of the camshaft sprocket shown in FIG. 1.
Figure 8:
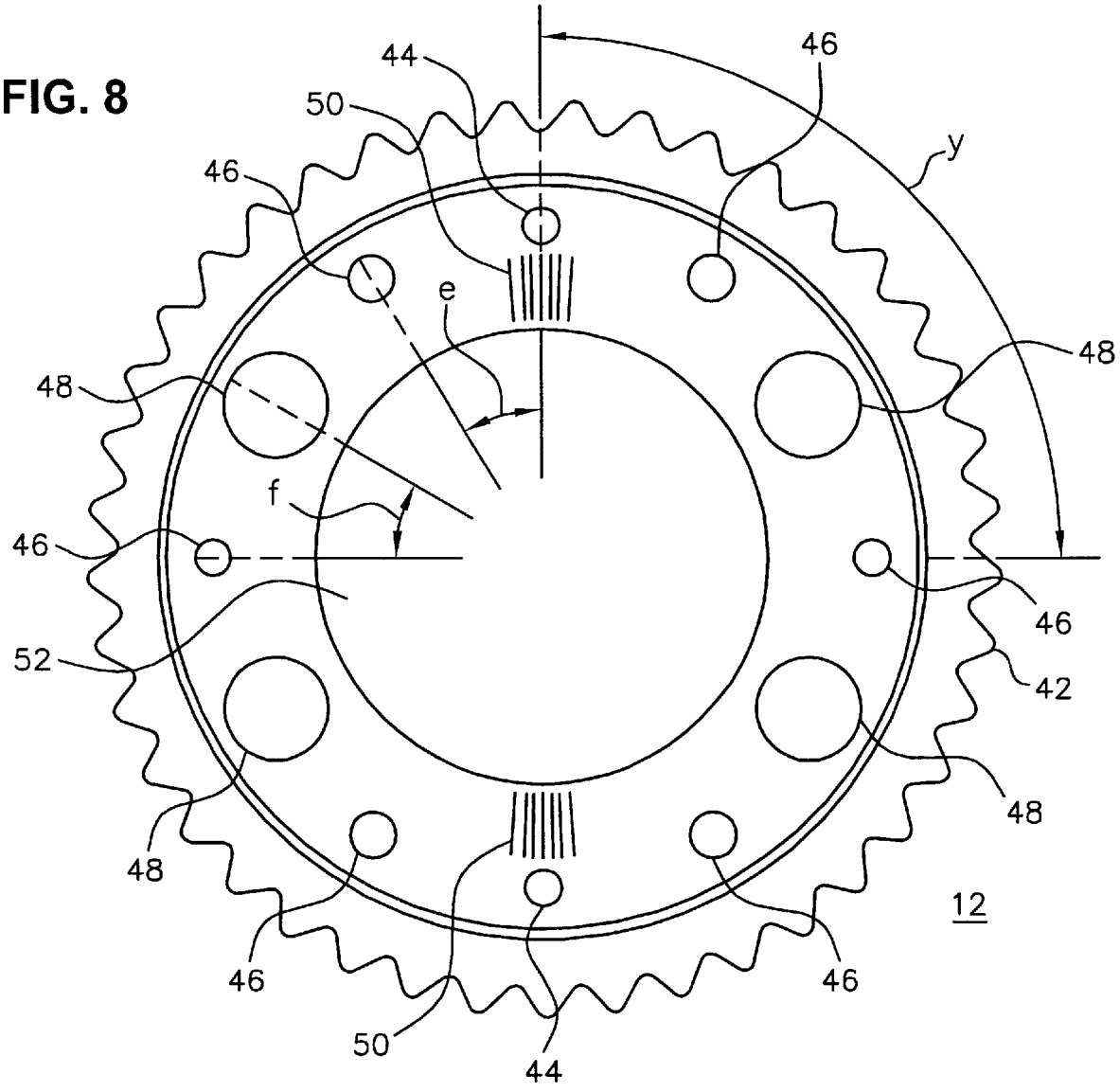
FIG. 8 is a top view of the camshaft sprocket shown in FIG. 1.

A top view and side view of an exemplary camshaft sprocket 12 are shown in FIGS. 8 and 9, respectively. Camshaft sprocket 12 has plurality of teeth 42 spaced around its perimeter. The number, size and dimensions of teeth 42 are dependent upon the particular engine for which camshaft sprocket assembly 10 is being used. A center recess (or hole) 52 is for receiving and nesting with rim 33 of camshaft sprocket hub 14.

A pair of long dowel recesses (or holes) 44 are positioned 180° apart from each other and approximately 30° apart from the adjacent threaded securing bolt openings 46. Each long dowel recess 44 is of a sufficient diameter to receive long dowel 26 of camshaft timing adjustment tool 20 when inserted. In an exemplary embodiment, each threaded securing bolt opening 46 is spaced approximately 60° on center from each of its adjacent threaded securing bolt opening 46. Each threaded securing bolt opening 46 is of a sufficient depth and diameter to receive and secure a securing bolt 18 when inserted and tightened to the appropriate torque.

Four optional weight reduction openings 48 are used in an exemplary embodiment.

A plurality of index markings 50 are shown interior to each long dowel recess 44. Index markings 50 are optional. When present, index markings 50 can show the user the degree of advance or retard of camshaft sprocket assembly.

For example, index markings 50 can take the form of index lines, with each index line corresponding to a specified degree of increment. In further example, each index line could represent a 2° increment of advance (towards the left for the view shown in FIG. 8) or retard (towards right for the view shown in FIG. 8). In still a further embodiment, (not shown) each index line can have a numeric or other symbol marking to clearly advise the user of what degree of advance or retard is set or being set by the timing adjustment. Index markings 50 and any numeric or other symbol can be stamped or etched into camshaft sprocket 12.

Figure 11:
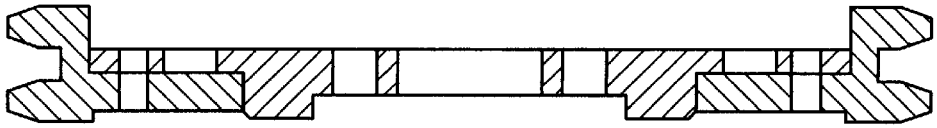
FIG. 11 is a side view of the camshaft sprocket hub fitted with the camshaft sprocket shown in FIG. 1.
Figure 12:
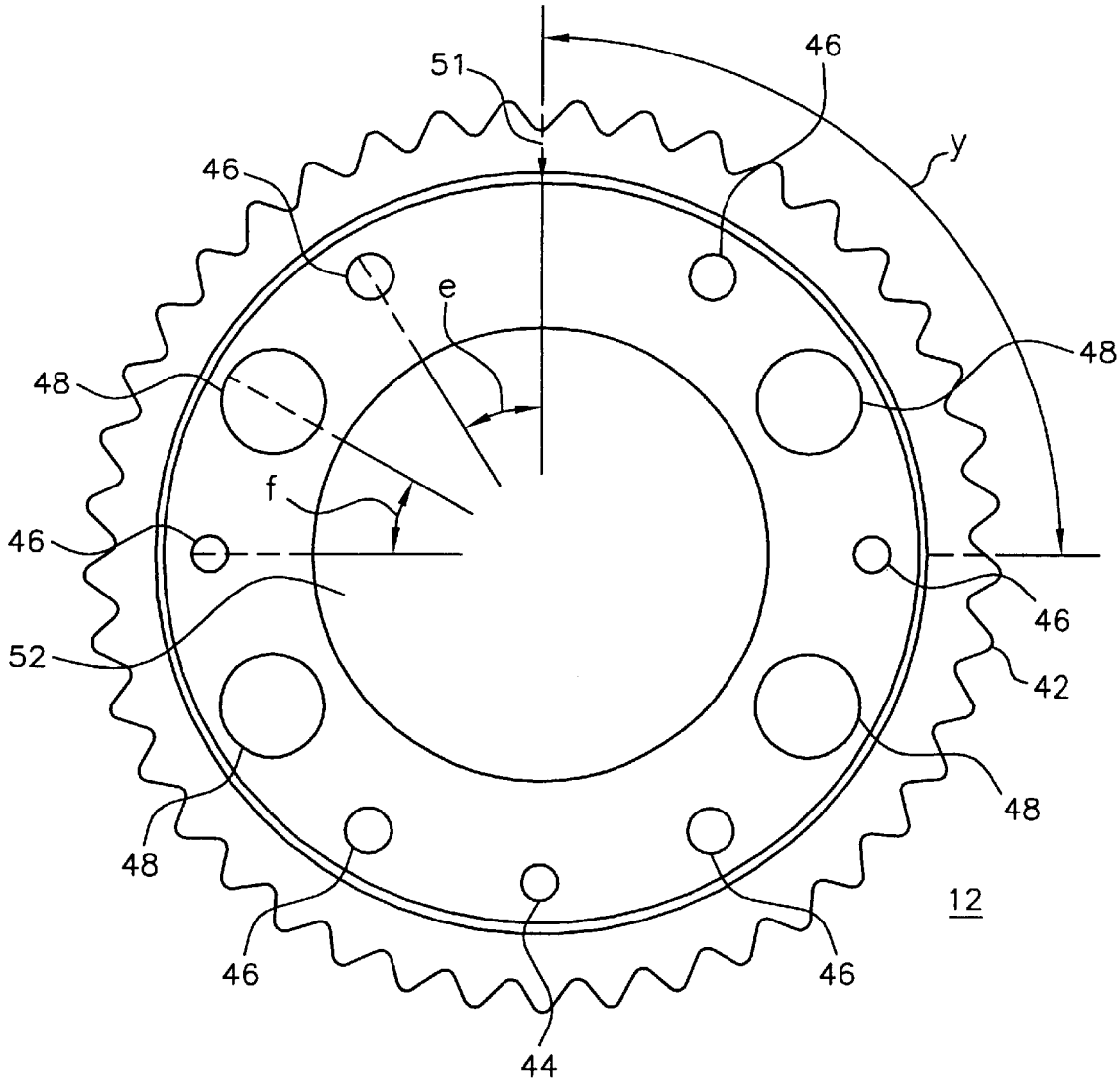
FIG. 12 is a top view of a preferred embodiment of the camshaft sprocket shown in FIG. 1.
Figure 13:
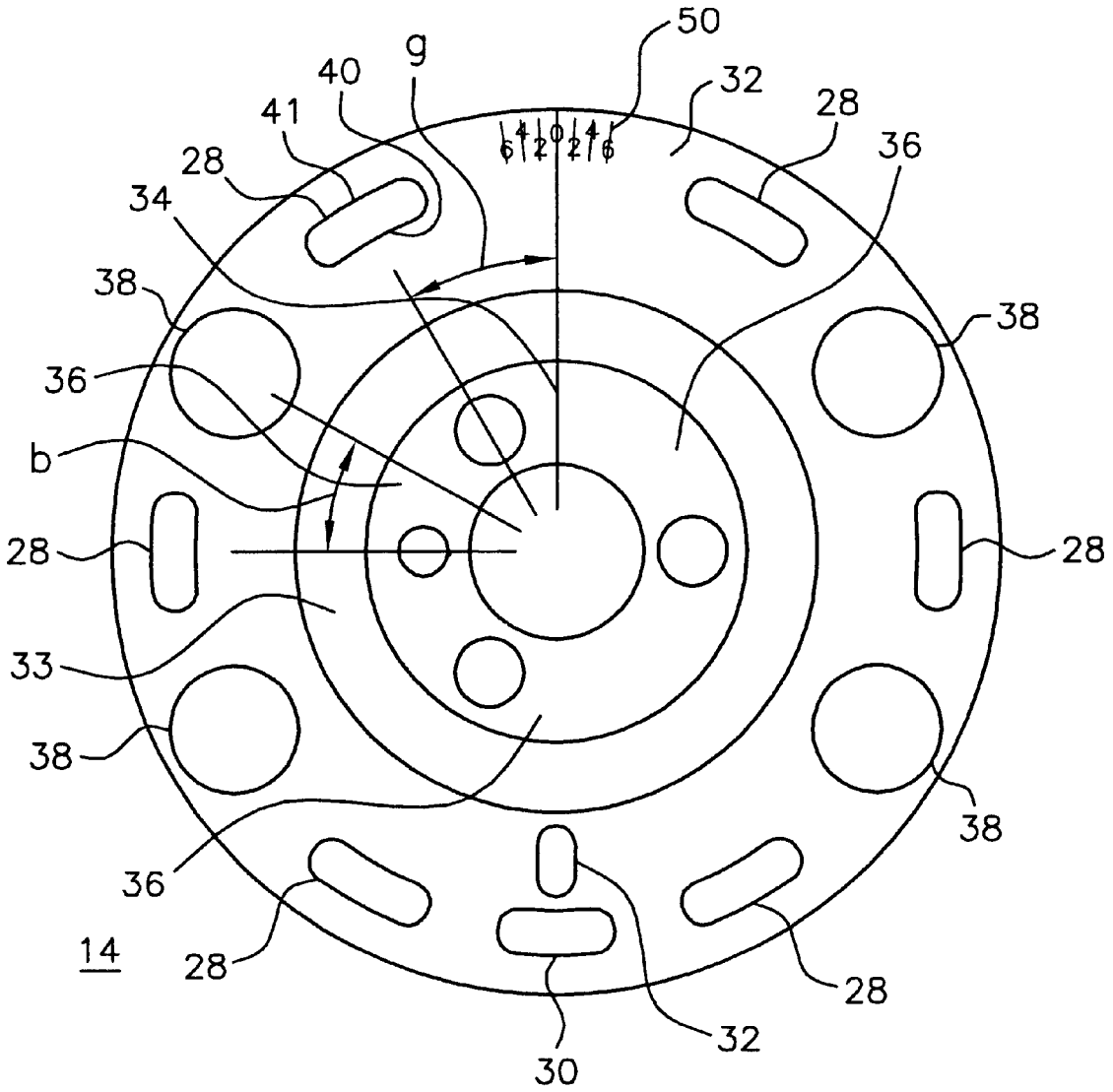
FIG. 13 is a top view of a preferred embodiment of the camshaft sprocket hub shown in FIG. 1.

In an exemplary preferred embodiment, shown in FIGS. 11 and 12, index markings 50 are stamped or etched onto camshaft hub 14, in place of one of the long dowel openings 30. Index markings 50 are numbered in degree increments 6,4,2,0,2,4,6, with 0 marking the center line. An index marking indicator or arrow 51 is stamped or etched onto camshaft sprocket 12. Index marking arrow 51 is located such that it can be seen when camshaft sprocket hub 14 is mated with camshaft sprocket 12. In use, index marking arrow 51 will align with one of the index markings 51 to show the degree of advance or retard that has been adjusted by the user. Such an arrangement may make it easier for the user to see the adjustment being made. In an exemplary embodiment, camshaft sprocket assembly 10 is used for a Chevrolet® small block engine. For such an embodiment, camshaft sprocket gear 12 is machined from a blank of SAE 1144 billet steel; with 44 teeth 42 having a pitch of 0.375; six threaded securing bolt openings 46 are present, each being a ¼ (28) tap hole; and the following are approximate measurements for some of the dimensions shown in FIGS. 8 and 9.

| | |
|---|---|
| H = 5.350" | $\epsilon = 30°$ |
| I = 4.38" | $\phi = 30°$ |
| J = .030" | $\gamma = 45°$ |
| K = .605" | $\eta = 45°$ |
| L = .205" | $\iota = 15°$ |
| M = .035" | $\phi = 86°$ |
| N = 2.626–2.628" | |
| O = 4.376–4.378" | |
| P = 4.440" | |

Figure 10:
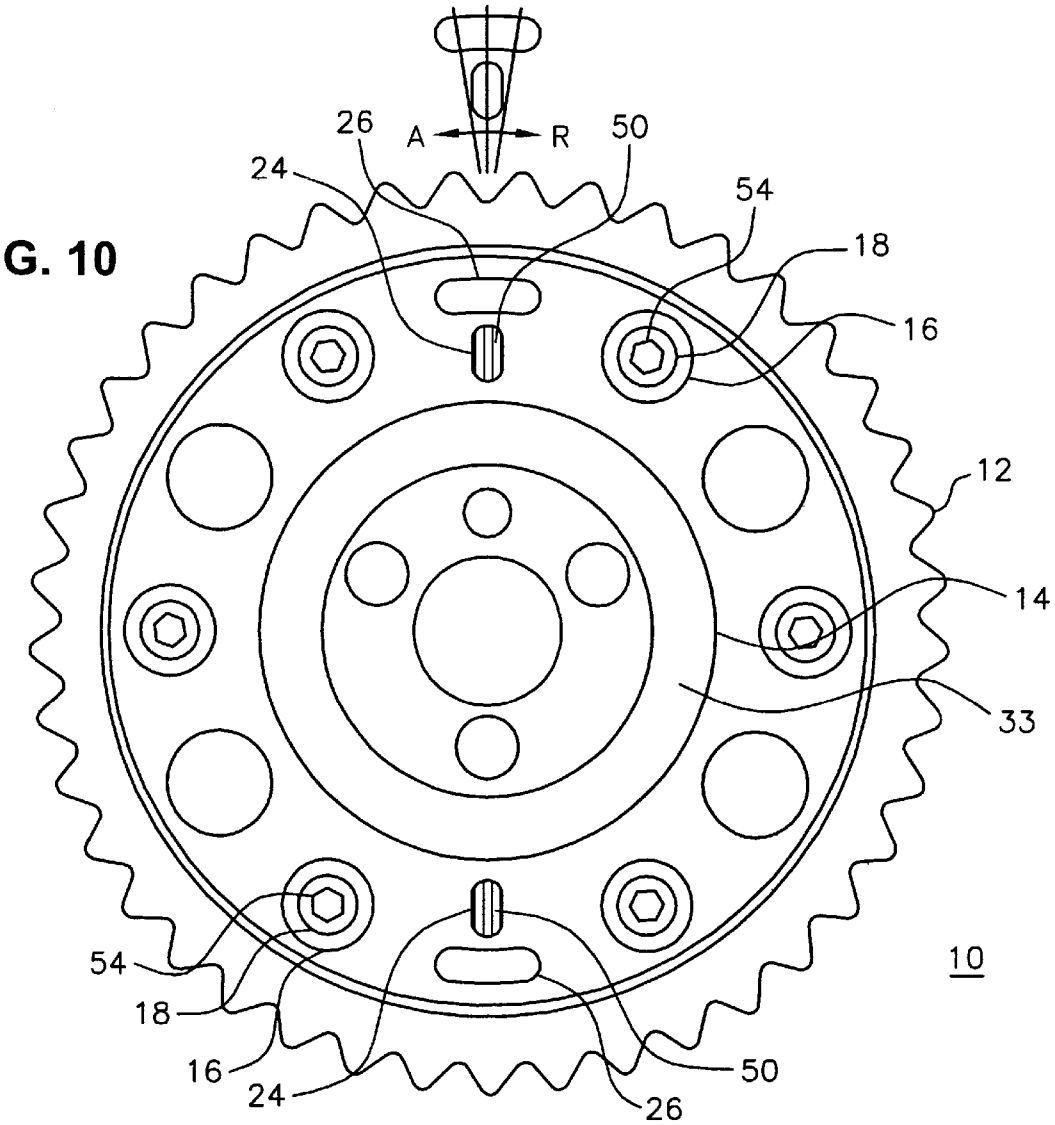
FIG. 10 is a top view of the camshaft sprocket hub fitted with the camshaft sprocket shown in FIG. 1.

FIGS. 10 and 11 show top and side views, respectively, of camshaft sprocket assembly 10 with camshaft sprocket hub 14 nested with camshaft sprocket 12 and secured by securing bolts 18. Washers 16 are positioned between the heads of camshaft securing bolts 18 and the surface of camshaft hub 14. Camshaft securing bolts 18 are shown with a hex recess (allen bolt) head. Other head configurations for the securing means will be understood by those skilled in the art.

In operation, a camshaft sprocket assembly 10 is already mounted on a camshaft with a timing chain fitted around teeth 42 and crankshaft sprocket (not shown) and thus, installed in a vehicle. To adjust the timing to a desired position, a user first loosens securing bolts 18 to allow movement of camshaft sprocket 12 independent of camshaft sprocket hub 14. In an exemplary embodiment, six securing bolts 18 are provided. A user then inserts short dowel 24 and long dowel 26 of timing adjustment tool 20 into the respective openings in camshaft hub 14. Short dowel 24 does not penetrate through camshaft hub 14, while long dowel 26 does. Long dowel 26 is inserted through long dowel recess 44 in camshaft sprocket 12. Handle extension 29 of timing adjustment tool 20 is inserted into the receiving end of a socket wrench (not shown) or similar tool to provide leverage for the timing adjustment. The socket wrench or similar tool is set to allow motion in the desired direction—advance or retard. Long dowel 26 acts as a pivot point, around which short dowel 24 can "scribe an arc" within the window of adjustment range that camshaft sprocket assembly 10 has been machined to provide. In an exemplary embodiment, the window of adjustment range is 12° (6° advance and 6° retard). A user can check the advance or retard setting by using index markings 50, if provided. When the desired timing setting is reached, the user tightens securing bolts 18 to lock camshaft sprocket 12 to camshaft hub 14.

While particular embodiments of the present invention are disclosed herein, it is not intended to limit the invention to such disclosure, and changes and modifications may be incorporated and embodied within the scope of the following claims.

What is claimed:

1. An adjustable camshaft sprocket assembly for attachment to a camshaft, the assembly comprising:

a) a camshaft sprocket hub; and b) a camshaft sprocket removably securable to said camshaft sprocket hub and moveable, independent of said cam shaft sprocket hub when said camshaft sprocket assembly is mounted on said camshaft;

wherein said camshaft sprocket hub further comprises positioning adjustment means for receiving an independent adjustment tool having at least two extensions, to rotate said camshaft sprocket independently of said camshaft sprocket hub.

2. An adjustable camshaft sprocket assembly in accordance with claim 1 said camshaft sprocket hub further comprising at least two adjustment tool openings for receiving an adjustment tool.

3. An adjustable camshaft sprocket assembly in accordance with claim 2, wherein said adjustment tool has a number of extensions corresponding to the number of adjustment tool openings in said camshaft sprocket hub for receiving said adjustment tool, and each of said adjustment tool openings having a size corresponding to a respective extension of said adjustment tool.

4. An adjustable camshaft sprocket assembly in accordance with claim 3 wherein said two adjustment tool openings comprise a first adjustment tool opening for allowing said adjustment tool to extend through said camshaft sprocket hub into said camshaft sprocket to serve as a pivot point, about which said adjustment tool can rotate and a second adjustment tool opening for adjusting said camshaft sprocket.

5. An adjustable camshaft sprocket assembly in accordance with claim 1, said camshaft sprocket hub further comprises a rim section nestable within an opening of said camshaft sprocket.

6. An adjustable camshaft sprocket assembly in accordance with claim 1, said camshaft sprocket hub further comprising mounting means for securing said camshaft sprocket hub to said camshaft.

7. An adjustable camshaft sprocket assembly in accordance with claim 1, further comprising fastening means for securing said camshaft sprocket to said camshaft sprocket hub.

8. An adjustable camshaft sprocket assembly in accordance with claim 7, said camshaft sprocket hub further comprising fastener openings for said fastening means to pass through and contact said camshaft sprocket.

9. An adjustable camshaft sprocket assembly in accordance with claim 7, wherein said fastening means comprises threaded bolts and a complimentary threaded opening in said camshaft sprocket.

10. An adjustable camshaft sprocket assembly in accordance with claim 1, said fastener openings having a substantially oval shape.

11. An adjustable camshaft sprocket assembly in accordance with claim 1, said camshaft sprocket further comprising threaded openings for securing said camshaft sprocket to said camshaft sprocket hub.

12. An adjustable camshaft sprocket assembly in accordance with claim 1, said camshaft sprocket further comprising index markings.

13. An adjustable camshaft sprocket assembly in accordance with claim 12, wherein said index marking are stamped or etched onto said camshaft sprocket.

14. An adjustable camshaft sprocket assembly in accordance with claim 12, wherein said index markings further comprise numbers indicating timing advance and timing retard adjustments.

15. An adjustable camshaft sprocket assembly in accordance with claim 12, wherein said index markings are located in a position where they can be seen though a corresponding opening in said camshaft sprocket hub.

16. An adjustable camshaft sprocket assembly in accordance with claim 1, said camshaft sprocket further comprising at least one opening for nesting with at least one corresponding raised section of said camshaft sprocket hub.

17. An adjustable camshaft sprocket assembly in accordance with claim 1, said camshaft sprocket further comprising positioning adjustment means for receiving an adjustment tool to rotate said camshaft sprocket independent of said camshaft sprocket hub.

18. An adjustable camshaft sprocket assembly in accordance with claim 17 further comprising a pair of positioning adjustment means, either one of which can be used to adjust said camshaft sprocket assembly.

19. An adjustable camshaft sprocket assembly in accordance with claim 1, said camshaft sprocket further comprising at least one adjustment tool opening for receiving an adjustment tool.

20. An adjustable camshaft sprocket assembly in accordance with claim 19 wherein said at least one adjustment tool opening is surrounded by a rim, said adapted to fit within a corresponding opening in said camshaft sprocket hub.

21. An adjustable camshaft sprocket assembly in accordance with claim 19, wherein said adjustment tool has two extensions corresponding to the number of adjustment tool openings in said camshaft sprocket for receiving said adjustment tool, and each of said adjustment tool openings having a size corresponding to a respective extension of said adjustment tool.

22. An adjustable camshaft sprocket assembly in accordance with claim 1 wherein said camshaft hub is comprised of metal.

23. An adjustable camshaft sprocket assembly in accordance with claim 1 wherein said camshaft sprocket is comprised of metal.

24. An adjustable camshaft sprocket assembly for attachment to a camshaft, the assembly comprising:

a) a camshaft sprocket hub having at least two adjustment tool openings for receiving an adjustment tool having two extensions, each tool opening having a size corresponding to a respective extension of said adjustment tool; and b) a camshaft sprocket removably securable to said camshaft sprocket hub and moveable, independent of said camshaft sprocket hub when said camshaft sprocket assembly is mounted on said camshaft;

wherein said two adjustment tool openings comprise a first adjustment tool opening for allowing said adjustment tool to extend through said camshaft sprocket hub into said camshaft sprocket to serve as a pivot point, about which said adjustment tool can rotate and a second adjustment tool opening for adjusting said camshaft sprocket.

25. An adjustable camshaft sprocket assembly in accordance with claim 5, wherein said second adjustment tool opening is substantially circular shaped.

26. An adjustable camshaft sprocket assembly in accordance with claim 25, wherein said first adjustment tool opening is substantially oval shaped.

27. An adjustable camshaft sprocket assembly in accordance with claim 26 said first adjustment tool opening positioned perpendicular to said second adjustment tool opening.

28. An adjustable camshaft sprocket assembly in accordance with claim 24, said first adjustment tool opening positioned between said second adjustment tool opening and said center of said camshaft hub.

29. An adjustable camshaft sprocket assembly for attachment to a camshaft, the assembly comprising:

a) a camshaft sprocket hub; and b) a camshaft sprocket removably securable to said camshaft sprocket hub and moveable, independent of said camshaft sprocket hub when said camshaft sprocket assembly is mounted on said camshaft, said camshaft sprocket further comprising at least one adjustment tool opening for receiving an adjustment tool having two extensions corresponding to the number of adjustment tool openings in said camshaft sprocket, each of said adjustment tool openings having a size corresponding to a respective extension of said adjustment tool.

30. An adjustable camshaft sprocket assembly in accordance with claim 29, wherein said at least one adjustment tool opening is adapted to receive said adjustment tool and cause said camshaft sprocket to rotate independent of said camshaft sprocket hub.

31. An adjustable camshaft sprocket assembly in accordance with claim 30, wherein said at least one adjustment tool opening is substantially round.

32. An independent adjustment tool for an adjustable camshaft sprocket assembly, said adjustable camshaft sprocket assembly having a camshaft sprocket hub, a camshaft sprocket removably securable to said camshaft sprocket hub and moveable, independent of said camshaft sprocket hub when said camshaft sprocket assembly is mounted on said camshaft, at least two openings in said camshaft hub, at least one opening in said camshaft sprocket, comprising:

a) a first extension of a size to fit within one of said openings in said camshaft hub;

b) a second extension of a size to pass though said other opening in said camshaft hub and fit within said at least one opening in said camshaft sprocket; and c) a handle extension for turning said adjustment tool about said first extension.

33. An adjustment tool in accordance with claim 32, further comprising a body portion from which said first and second extensions and said handle extension extend.

34. An adjustment tool in accordance with claim 32 wherein said first and second extensions are substantially circular in diameter.

35. An adjustment tool in accordance with claim 32 wherein said handle extension is adapted to fit a socket wrench or slot for screwdriver.

36. An adjustment tool in accordance with claim 32 wherein said first and second extensions are made from steel.

37. An adjustable camshaft sprocket assembly for attachment to a camshaft and adjustment with an adjustment tool, said adjustment tool having first and second extensions, comprising:

a) a camshaft sprocket hub, said camshaft sprocket hub, having;

i) a first opening adapted to receive said first extension of said adjustment tool to allow said first extension to pass through said camshaft sprocket hub ii) a second opening adapted to receive said second extension of said adjustment tool and allow said second extension of said adjustment tool to serve as a pivot for said adjustment tool iii) securing bolt openings iv) a rim;

b) camshaft sprocket removably securable to said camshaft sprocket hub and moveable, independent of said camshaft sprocket hub when said camshaft sprocket assembly is mounted on said camshaft, having i) a third opening said third opening adapted to receive said first extension of said adjustment tool and cause said camshaft sprocket to rotate independent of said camshaft sprocket hub ii) threaded securing bolt openings iii) index markings indicating timing advance and timing retard adjustments; and c) threaded securing bolts that pass through said securing bolt openings of said camshaft hub and are threaded into said threaded securing bolt openings of said camshaft to secure said camshaft sprocket hub to said camshaft sprocket.

* * * * *